United States Patent [19]

Dion

[11] 4,130,952

[45] Dec. 26, 1978

[54] PLOW ATTACHMENT FOR ROTO-TILLER

[76] Inventor: Exsior Dion, 547 River Rd., Lincoln, R.I. 02865

[21] Appl. No.: 836,244

[22] Filed: Sep. 23, 1977

[51] Int. Cl.[2] ..... E01H 5/04; A01B 65/06

[52] U.S. Cl. ..... 37/41; 37/42 VL; 37/DIG. 3; 172/245; 172/358; 172/364

[58] Field of Search ..... 37/41, 50, 53, 42 VL, 37/DIG. 3, 42 R, 130; 172/245, 250–253, 358, 365, 14, 42, 63, 70, 75, 43

[56] References Cited

U.S. PATENT DOCUMENTS

| | | | |
|---|---|---|---|
| 3,515,220 | 6/1970 | Reece | 172/245 |
| 3,647,005 | 3/1972 | Boyd | 172/358 X |
| 3,792,734 | 2/1974 | Ellis et al. | 172/358 |

FOREIGN PATENT DOCUMENTS

| | | | |
|---|---|---|---|
| 500352 | 3/1954 | Canada | 37/53 |
| 13757 | 11/1955 | Fed. Rep. of Germany | 37/41 |
| 605450 | 3/1960 | Italy | 37/42 R |
| 776765 | 6/1957 | United Kingdom | 172/358 |

*Primary Examiner*—E. H. Eickholt

*Attorney, Agent, or Firm*—Robert J. Doherty

[57] ABSTRACT

A plow attachment for a roto-tiller wherein the roto-tiller includes a frame, a gear housing downwardly extending from the frame, means for driving a front axle shaft on each side of the gear housing, rear guide wheels, and means for driving said front wheels including a gear housing downwardly extending from the frame between said front wheels. The attachment includes a blade suspended from the forward end of a yoke which in turn includes a pair of parallel rearwardly extending members positioned so as to straddle the gear housing and a pair of front driving wheels. The yoke is pivotally mounted at the rear ends thereof to a pair of legs downwardly extending from the frame. A lift lever is pivotally mounted to the frame at an intermediate portion and connected at its forward end to the blade. The rear end of the lift lever is constantly urged upwardly by a spring and a combination adjustment and stop means is provided so as to positively position the lift lever and accordingly regulate the height at which the blade is disposed to the roto-tiller.

6 Claims, 4 Drawing Figures

PLOW ATTACHMENT FOR ROTO-TILLER

BACKGROUND AND SUMMARY OF THE INVENTION

This invention relates to a material pushing attachment for a roto-tiller and more specifically to a snow plow attachment therefor. Various attachments for farm implements such as tractors and the like are known. It is further known to provide attachments so as to convert an automobile or truck into a snow plow, however a common implement utilized increasingly by the home owner is a roto-tiller and while such has utility only on a seasonal basis, attachments are not available to extend the seasonal use thereof.

It is accordingly a primary object of the present invention to provide a material pushing attachment for a roto-tiller and particularly that type of roto-tiller which includes front driving means such as tines mounted on either side of a gear housing extending downwardly from a frame thereof.

A further object of the present invention is to provide an attachment for the above-described type roto-tiller, which attachment can be utilized to push materials such as snow or earth and accordingly extend both the seasonal and operational utility of such roto-tiller.

Another object of the present invention is to provide an attachment of the above-described type in which it can be conveniently mounted and removed from the roto-tiller with practical ease and requiring no special tools.

A still further object of the present invention is the provision of an attachment of the aforementioned type in which the blade portion thereof is adjustable to various vertical heights as well as various arcuate positions in a horizontal plane.

These and other objects of the present invention are accomplished by an attachment including a pair of front driving wheels. The attachment also includes a yoke in turn having a blade attached to the forward end thereof and including a pair of parallel rearwardly extending members positioned so as to straddle the gear housing of the roto-tiller and pivotally mounted at the rear end thereof to opposed legs downwardly extending from the roto-tiller frame. The attachment includes a lift lever having an intermediate section thereof connected to said frame for pivotal movement with respect thereto, the forward end of said lift lever extending above the forward end of said yoke and pivotally interconnected thereto and combination adjustment and stop means for moving the rear end of said lift levers so as to raise and lower said blade, said means mounted on said frame proximal the rear wheels and spring means for constantly urging said lever rear end upwardly against said stop means so as to prevent upward travel of said material pushing blade.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

Description of the Invention

Figure 1:
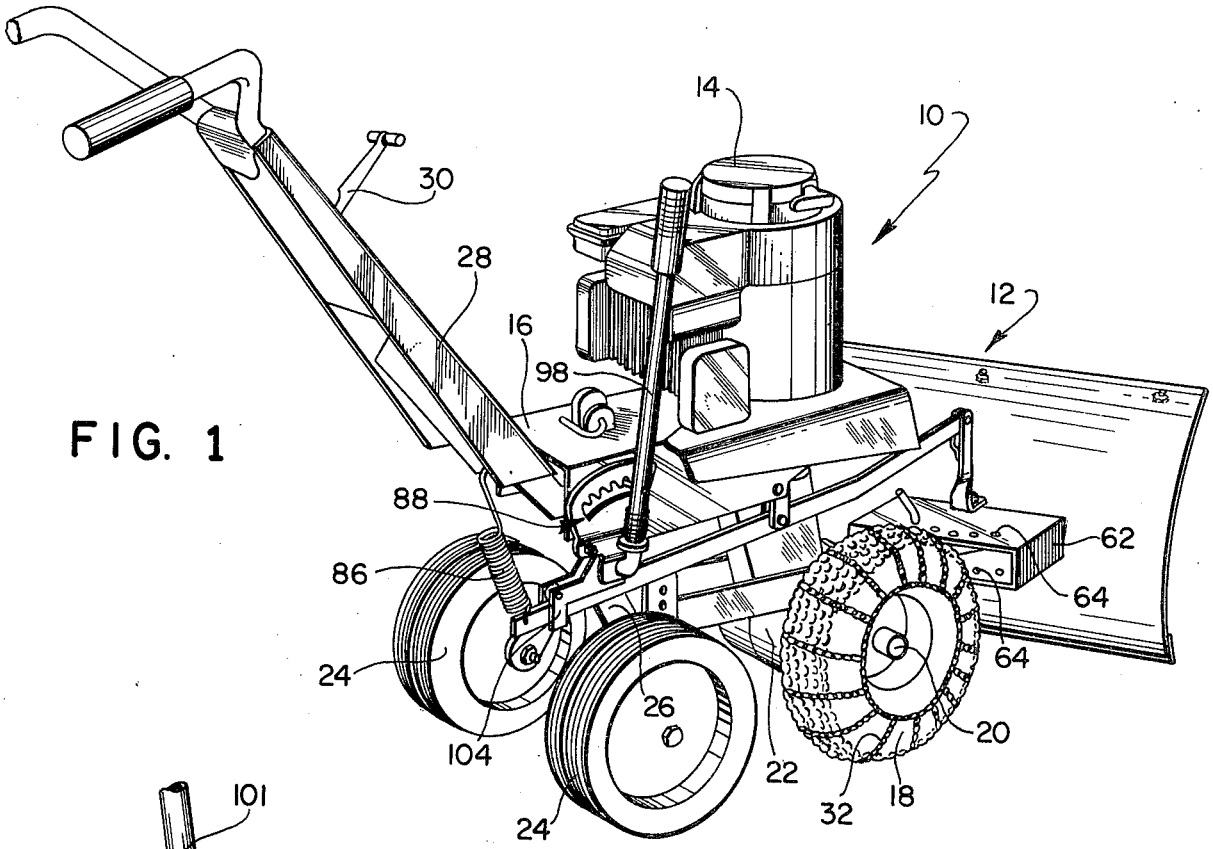
FIG. 1 is a perspective view of a roto-tiller with the attachment of the present invention positioned thereon.
Figure 2:
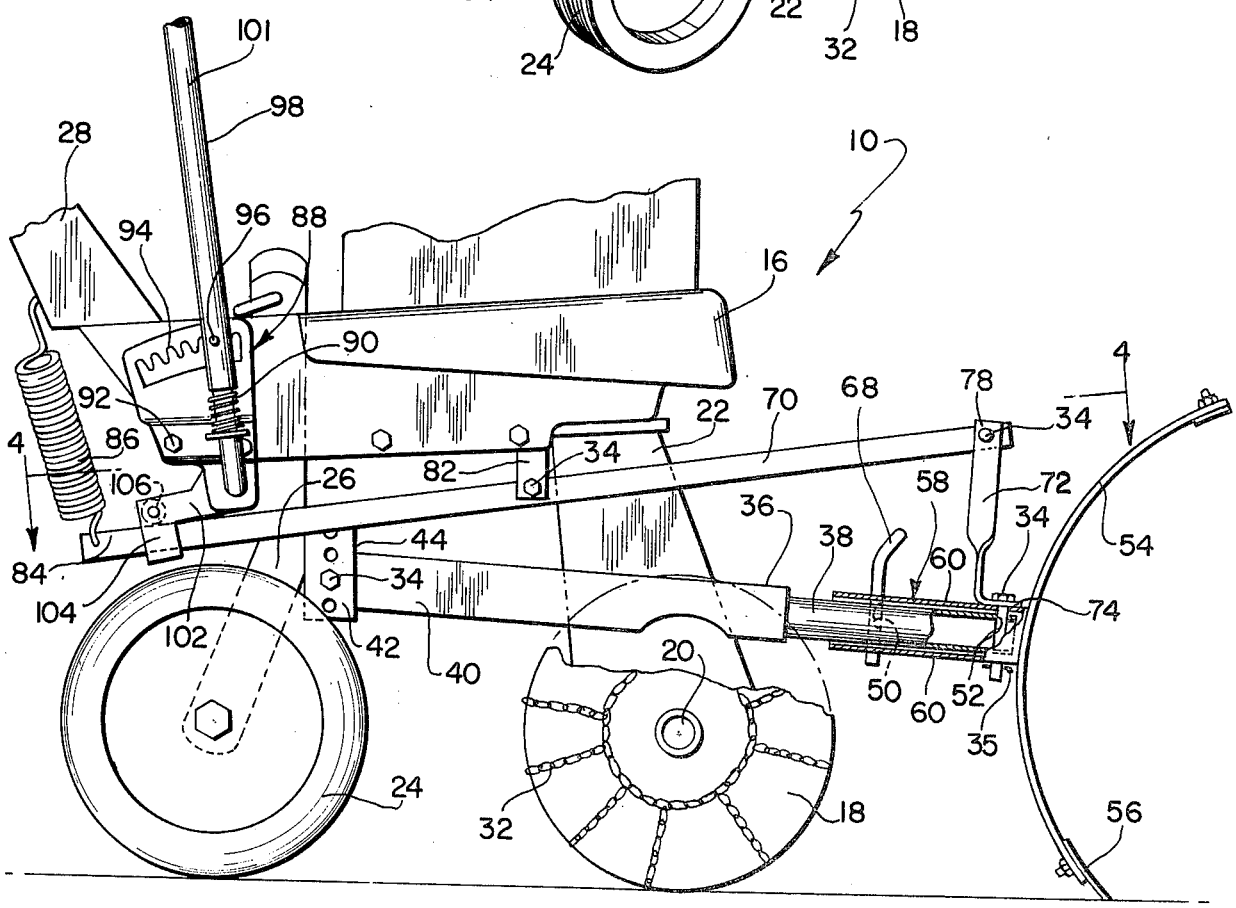
FIG. 2 is a side elevational view of the roto-tiller and attachment shown in FIG. 1 with the blade portion thereof in a lowered use position.
Figure 3:
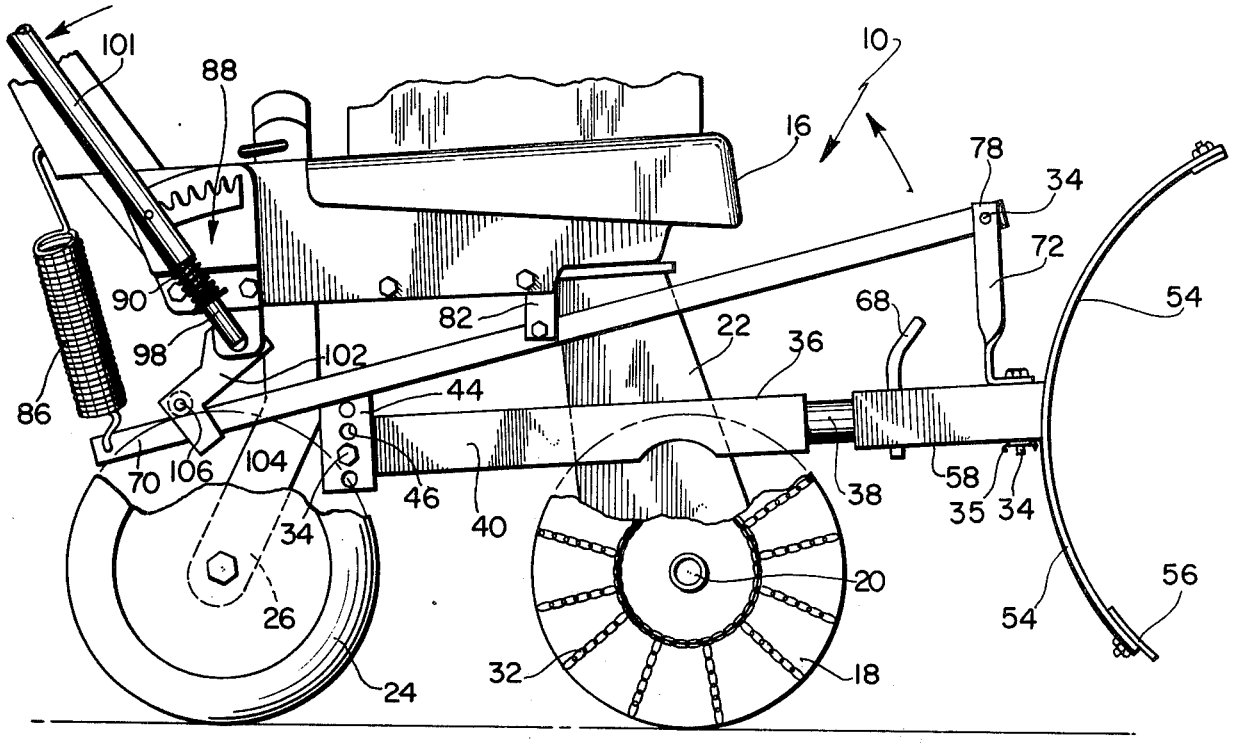
FIG. 3 is a side elevational view similar to FIG. 2 but showing the blade in a raised position.

Turning now to FIG. 1 of the drawings, the construction of the type roto-tiller 10 with which the attachment 12 of the present invention is adapted for use is best shown. Such roto-tiller 10 includes an engine 14, generally a gasoline type mounted on a frame 16 and adapted to drive a pair of front wheels 18 mounted on axles 20 means of suitable gears mounted within a gear housing 22. The gear housing 22 in turn extends downwardly from the frame 16 and is disposed at least partially between the front wheels 18. A pair of rear wheels 24 is positioned to the rear thereof and suitably secured to the frame 16 as by means of an inverted V-shaped element or yoke 26. A suitable handle 28 is provided for the roto-tiller 10 from which controls 30 to engage or disengage gearing through a clutch mechanism (not shown) may be provided.

Figure 4:
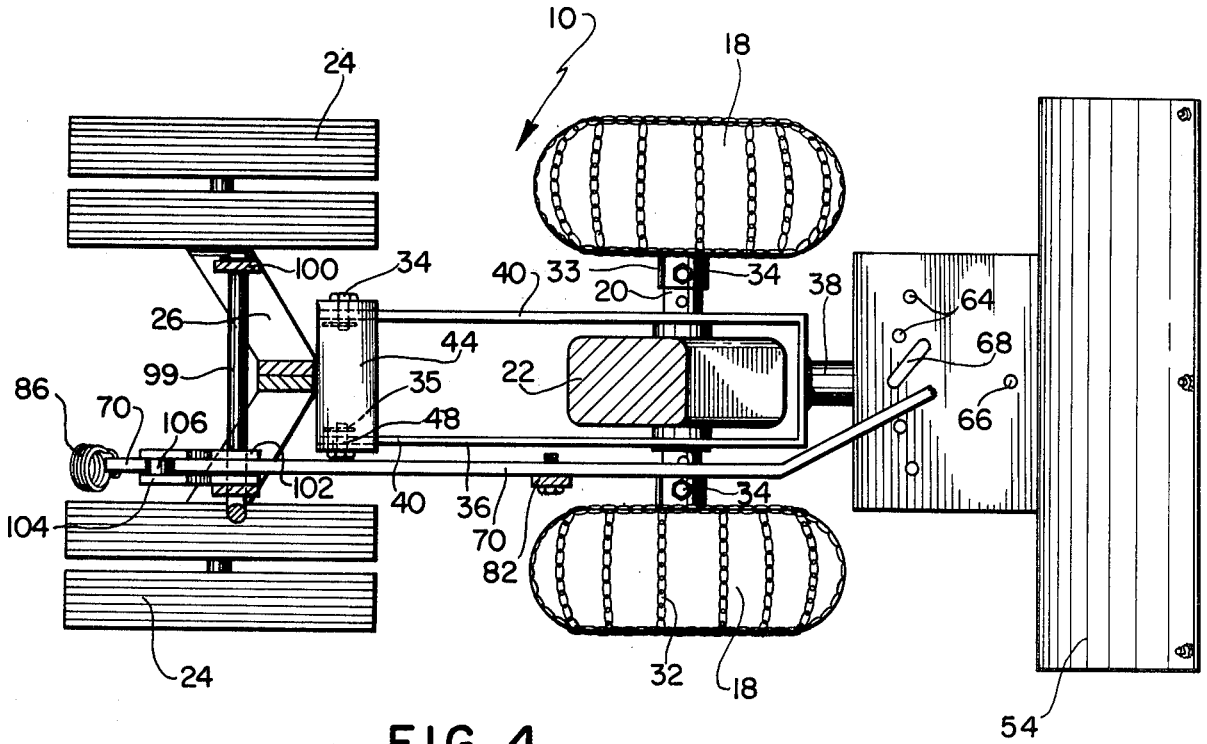
FIG. 4 is a plan sectional view taken along the line 4—4 of FIG. 2.

Normally the roto-tiller 10 is provided with a plurality of tines (not shown) which are driven by rotation of the axles 20 and accordingly serve to cultivate the soil by the turning action imparted thereto. In the present case, however, the blades are removed and the front wheels 18 substituted therefor. Such wheels may be provided with traction means, if needed such as the chains 32 shown. Generally the front wheels 18 are slipped over the axles 20 by means of an inner hub 33 adapted to extend over the terminal ends of the axle 20 and through which aligned openings are provided so as to receive a pin 34 therethrough and through a co-aligned opening in the axle itself. Several openings may be provided in the outer ends of the axle so as to provide for lateral adjustment of the wheels 18 with respect to one another. The pins by which the wheels 18 are attached to the axle 20 are also preferably clevis pins for which lock pins are provided (see FIG. 4 of the drawings).

The attachement 12 includes a yoke 36 generally of Y-shaped or bifurcated configuration having a forwardly extending bar 38 and a pair of generally parallel rearwardly extending members 40 which serve to straddle the gear housing 22 on either side thereof. The rear ends of such members 40 are pivotally attached to the opposed leg portions 42 of an inverted U-shaped element 44 attached to the frame 16 as by welding. A convenient location for such weld attachment is at the forward end of the inverted V-shape yoke 26 serving to mount the rear wheels 24 but other suitable locations could be utilized. The legs 44 include a plurality of horizontally aligned openings 46 and the rear end of each of the members 40 are provided with a similar opening 48. The openings 46,48 of proximal legs and members are adapted to be aligned with each other and another clevis pin 34 such as that previously described positioned therethrough so as to mount the yoke 36 to leg portions 42 of an inverted U-shaped element 44 to allow pivotal movement in a vertical plane with respect to the frame. A bendable lock pin 35 holds the clevis pins 34 in position.

The forward end 38 of the yoke 36 includes a first opening 50 therethrough and a second opening 52, such openings adapted to receive clevis pins for purposes which will be evident as the description proceeds. The blade 54 is generally of curbed configuration and provided at its lower end with a scraper element 56 including a housing 58 extending rearwardly from intermediate portions thereof. The housing 58 includes a pair of spaced walls 60 which cooperate to form a box-like enclosure into which the forward end 38 of the yoke 36 is adapted to be received. The enclosure may also be provided with side walls 62. The top and bottom walls 60 are provided with first openings 64 and arranged in a pair of arcuate paths and a single second opening 66. This second opening 66 is aligned with the opening 52 and is adapted to receive a clevis pin 34 and lock pin 35 and in this way secure the blade 54 to the yoke 36. In order to move the blade arcuately in a horizontal plane, the blade 54 may be pivotally moved about the clevis pin 34 disposed within the openings 50 and 64 and in this way material such as snow may be directed to the left or right of the roto-tiller when the attachment is positioned thereof and in this manner facilitate further functions of a plow. In order to fix such arcuate position of the blade 54 with respect to the roto-tiller a tapered pin 68 is adapted to be positioned through a pair of aligned openings 64 and the first opening 50 provided through the forward end 38 of the yoke.

In order to provide for height adjustment of the blade with respect to the ground and, of course, the roto-tiller, a lift lever 70 in the form of a longitudinally extending bar is provided. The forward end of such bar 70 includes a downwardly extending arm 72 pivotally attached thereto and terminating in a pad 74 which is in turn provided with an opening 76 (not shown). The overall shape of the arm 72 is of an L-shaped twisted configuration and may terminate in a yoke or bifurcated element 78 through which a clevis pin 34 serves to pivotally connect such to the forward end of the lift lever 70. The pad 74 is adapted to contact upper forward portions of the enclosure 58 and the same clevis pin 34 which passes through the openings 66 and 52 is adapted to pass through the opening 76 within the pad 74. In this way then, both the yoke 36 and the lift lever 70 are simultaneously connected to the blade 54 by means of the enclosure 58 rearwardly extending from the blade.

An intermediate portion of the lift lever 70 is pivotally suspended from the frame 16 by means of a tab or ear 82 downwardly extending therefrom. The rear end 84 of the lift lever 70 is attached to a spring 86 which in turn is connected to the frame 16 at a point vertically above it and in such a manner that an upward force is continually urged upon the end 84. This force in turn serves to attempt to force the forward end of the lift lever downwardly.

The effect of this action is, however, overcome or overridden by a combination adjustment and stop means 88. Such means 88 includes a quadrant plate 90 attached to the frame 16 as by bolts 92. Such quadrant includes finger positions 94 for engagement by a finger 96 in turn inwardly projecting from a lift handle 98. Such lift handle 98 is of conventional construction and includes a shell 101 upwardly spring urged and a lower L-shaped portion suitably journalled within tabs or ears 100 suitably dependent from the frame 16. Accordingly the handle 98 is adapted to be arcuately moved along the quadrant plate 90 in different positions. Attached to the L-shaped portion of the handle is a pair of lever guide bars 102. Such guide bars 102 include a pair of downwardly extending ears 104 between which the lift lever 70 is adapted to be positioned and a roller pin 106 which is adapted to contact the upper edge of the lift lever 70.

Inasmuch as the connection between the L-shaped portion of the handle 98 and the guide bars 102 is fixed, the arcuate movement of the handle 98 serves to in effect provide a stop which determines the upper extent to which the spring 86 can urge the rear end 84 of the lift lever 70 against the guide roller 106.

In practice the attachment 12 may be simply removed from the roto-tiller 10 by the removal of the lock pins 35 and the clevis pins 34 and the spring 86. In addition the front driving wheels 18 may be simply removed from the axles 20 by the removal of similar clevis pins 34 and lock pins 35. The rotating blade structures of the roto-tiller may then be replaced. In this manner, the attachment of the present invention provides a quick and easy assembly by which a standard type roto-tiller may be turned into an effective plow for snow or other material.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A material pushing attachment for a roto-tiller having a frame, front mounted tines, rear guide wheels, and means for driving said front mounted tines including a gear housing downwardly extending from said frame between said front wheels, said attachment including a pair of front driving wheels adapted to replace said tines, a yoke in turn having a blade attached at the forward end thereof and including a pair of parallel rearwardly extending members positioned so as to straddle said gear housing and pivotally mounted at the rear ends thereof to opposed legs downwardly extending from said frame, a lift-lever having an intermediate section thereof connected to said frame for pivotal movement with respect thereto, the forward end of said lift lever extending above the forward end of said yoke and pivotally interconnected thereto, and combination adjustment and stop means for moving the rear end of said lift lever so as to raise and lower said blade, said adjustment and stop means mounted on said frame proximal the rear wheels and spring means for constantly urging said lever rear end upwardly against said stop mens so as to prevent upward travel of said blade when pushing material.

2. The construction of claim 1, wherein the forward end of said yoke is received within a box-like enclosure having opposed top and bottom walls rearwardly extending from said blade, said enclosure and said blade arcuately positionable in a horizontal plane with respect to said yoke and means for fixing said relative arcuate position of said enclosure and blade with respect to said yoke and accordingly simultaneously with respect to said roto-tiller.

3. The construction of claim 2, said means for fixing the relative arcuate positioning of said blade being a pin adapted to extend through aligned openings in said enclosure walls in the forward end of said yoke, said openings in said walls disposed in parallel arcuate paths.

4. The construction of claim 1, said lift lever being a longitudinally orientated bar, a spring having one end attached to the rear end of said bar and the other end attached to said frame at a higher position so as to constantly urge the rear end of said bar upwardly, a lift handle mounted to said frame and arcuately positionable in a vertical plane, a pair of lift lever guide bars attached to said lift handle and movable therewith, said guide bars having a roller positioned therebetween and adapted to bear upon the upper edge of said lift lever bar, said contact between said lift lever bar and said roller forming a stop for limiting the upward travel of said blade about said yoke.

5. The construction of claim 3, said enclosure walls having a pair of aligned spaced openings positioned forwardly of said parallel path openings, a support arm running from the forward end of said lift lever to said enclosure, said support arm having a lower pad adapted to contact said enclosure, said support arm further having an opening adapted for alignment with said forward enclosure openings, said forward yoke end having a second opening also adapted for alignment with said forward enclosure openings and a pin adapted to pass through the opening in said pad, said forward enclosure openings and said second forward end yoke opening so as to simultaneously secure said blade to said yoke and said blade to said lift lever.

6. The construction of claim 1, said opposed legs being part of an inverted U-shaped element fixedly attached to said frame.

* * * * *